US009752791B2

(12) United States Patent
Mori et al.

(10) Patent No.: US 9,752,791 B2
(45) Date of Patent: Sep. 5, 2017

(54) AIR-CONDITIONING UNIT CONTROL DEVICE AND AIR-CONDITIONING UNIT CONTROL PROGRAM FOR MINIMIZING POWER CONSUMPTION

(71) Applicants: Kazuyuki Mori, Chiyoda-ku (JP); Shoichi Kitamura, Chiyoda-ku (JP); Hiroyuki Hashimoto, Chiyoda-ku (JP); Yohei Ueno, Chiyoda-ku (JP)

(72) Inventors: Kazuyuki Mori, Chiyoda-ku (JP); Shoichi Kitamura, Chiyoda-ku (JP); Hiroyuki Hashimoto, Chiyoda-ku (JP); Yohei Ueno, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 492 days.

(21) Appl. No.: 14/381,781

(22) PCT Filed: Jan. 15, 2013

(86) PCT No.: PCT/JP2013/050541

§ 371 (c)(1),
(2) Date: Aug. 28, 2014

(87) PCT Pub. No.: WO2013/145810

PCT Pub. Date: Oct. 3, 2013

(65) Prior Publication Data

US 2015/0045967 A1 Feb. 12, 2015

(30) Foreign Application Priority Data

Mar. 26, 2012 (JP) ..... 2012-069030

(51) Int. Cl.

| | |
|---|---|
| ***G05D 23/00*** | (2006.01) |
| ***F24F 11/00*** | (2006.01) |
| ***F24F 3/06*** | (2006.01) |

(52) U.S. Cl.
CPC ..... *F24F 11/0009* (2013.01); *F24F 3/065* (2013.01); *F24F 11/001* (2013.01); *F24F 11/006* (2013.01); *F24F 2011/0067* (2013.01)

(58) Field of Classification Search
None
See application file for complete search history.

(56) References Cited

U.S. PATENT DOCUMENTS

2008/0306632 A1 12/2008 Miki et al.
2011/0093121 A1* 4/2011 Wakuta ..... F24F 11/006 700/276

FOREIGN PATENT DOCUMENTS

CN 102042656 A 5/2011
JP 2001 108277 4/2001
(Continued)

OTHER PUBLICATIONS

Extended European Search Report issued May 20, 2016 in Patent Application No. 13769755.3.
(Continued)

*Primary Examiner* — Wissam Rashid
(74) *Attorney, Agent, or Firm* — Oblon, McClelland, Maier & Neustadt, L.L.P.

(57) ABSTRACT

An air-conditioning unit control device controls an air-conditioning unit system including one or more outdoor units and a plurality of indoor units. The air-conditioning unit control device includes an environment target value setting unit to set an environment target value for an environment intended to be achieved by air conditioning through each of the indoor units, a zone setting unit to form one or more groups of the indoor units and set a zone for each of the groups, a zone load calculating unit to calculate a heat load on the set zone, an air conditioning capacity allocation calculating unit to determine an allocation of operation capacity to each of the indoor units and the
(Continued)

outdoor units based on power consumption of each of the indoor units and the outdoor units, and a control instructing unit to transmit a control signal based on each operation capacity.

9 Claims, 10 Drawing Sheets

(56) References Cited

FOREIGN PATENT DOCUMENTS

| | | | |
|---|---|---|---|
| JP | 2006-17403 | A | 1/2006 |
| JP | 2006 29693 | | 2/2006 |
| JP | 2006 38334 | | 2/2006 |
| JP | 2008-75993 | A | 4/2008 |
| JP | 2008 157533 | | 7/2008 |
| JP | 2008 170141 | | 7/2008 |
| JP | 2009 174734 | | 8/2009 |
| JP | 2010-236732 | A | 10/2010 |
| JP | 2010 243090 | | 10/2010 |
| JP | 2010 255900 | | 11/2010 |
| JP | 2011-38705 | A | 2/2011 |
| JP | 2011 89679 | | 5/2011 |
| JP | 2011 153759 | | 8/2011 |
| JP | 2011 187030 | | 9/2011 |

OTHER PUBLICATIONS

Combined Chinese Office Action and Search Report issued May 16, 2016 in Patent Application No. 201380017028.X (with English language translation and English translation of categories of cited documents).

Office Action issued on Jul. 21, 2015 in Japanese Patent Application No. 2014-507460 with English translation.

International Search Report Issued Apr. 16, 2013 in PCT/JP13/050541 dated Jan. 15, 2013.

* cited by examiner (a)

(b)

AIR-CONDITIONING UNIT CONTROL DEVICE AND AIR-CONDITIONING UNIT CONTROL PROGRAM FOR MINIMIZING POWER CONSUMPTION

TECHNICAL FIELD

The present invention relates to an air-conditioning unit control device that controls an air-conditioning unit system including, for example, a plurality of indoor units.

BACKGROUND ART

In an air-conditioning unit system, for example, a space is physically partitioned into areas, one or more indoor units are installed in each area, and the indoor units and outdoor units (hereinafter, the indoor units and the outdoor units will also be referred to as "air-conditioning units") are controlled so that an environment in each area agrees with a predetermined target. For example, if an air conditioning capacity is insufficient in an arrangement of one indoor unit and one outdoor unit for each area, the number of indoor units and the number of outdoor units are increased to compensate for the insufficient air conditioning capacity.

Some of the systems including a plurality of air-conditioning units perform control based on loads on the air-conditioning units predicted by an empirical rule, any of various programming methods (such as mathematical programming and metaheuristic), or the like in order to reduce the power consumption of the entire system. In such a case, for example, operation points of a plurality of air-conditioning units are programmed on the basis of predicted loads on the air-conditioning units to control the air-conditioning units (see, Patent Literature 1, for example).

Furthermore, there is a method of achieving energy saving by specifying the position of a target which needs air conditioning and by specifying, as a control target group, one or more air-conditioning units that affect the target to efficiently control the air-conditioning units (refer to Patent Literature 2, for example).

CITATION LIST

Patent Literature

Patent Literature 1: Japanese Unexamined Patent Application Publication No. 2011-89679 (page 4, line 40 to page 5, line 24, FIG. 1)

Patent Literature 2: Japanese Unexamined Patent Application Publication No. 2009-174734 (page 9, lines 6 to 8, page 10, lines 36 to 40, FIG. 9)

SUMMARY OF INVENTION

Technical Problem

In such an air-conditioning unit system which includes a plurality of indoor units, each of the indoor units is disposed to control an environment in a predetermined space. For control of the air-conditioning unit system, if an actual load does not match the capacity of the indoor unit and the capacity of an outdoor unit, the environment in the space would fail to reach a target environment.

For example, in an office building where many people are present in a space, an intended environment may vary from one individual to another. Even if an environment agrees with a target environment set for each space, not all people always feel comfortable. Furthermore, the pursuit of only comfort results in an increase in energy consumption (power consumption).

The present invention has been made to overcome the above-described disadvantages and provides an air-conditioning unit control device capable of achieving an operation which ensures compatibility between achievement of a target environment in a space and energy saving operation.

Solution to Problem

The present invention provides an air-conditioning unit control device that controls an air-conditioning unit system including one or more outdoor units and a plurality of indoor units connected to the outdoor units by pipes, the indoor units being configured to condition air in a space. The air-conditioning unit control device includes an environment target value setting unit to set an environment target value for an environment intended to be achieved by air conditioning through each of the indoor units, a zone setting unit configured to form one or more groups of (or group) the indoor units and set a zone for each of the groups or change the zone, the zone serving as a subspace, a zone load calculating unit to calculate a heat load on the zone set or changed by the zone setting unit based on a difference between the environment target value and an environment-condition-related value detected by indoor environment condition detecting means in an installation position for each of the indoor units, an air conditioning capacity allocation calculating unit to calculate and determine an allocation of operation capacity to each of the indoor units and the outdoor units based on power consumption of each of the indoor units and the outdoor units so as to minimize the total power consumption, and a control instructing unit to transmit a control signal based on the operation capacity of each of the indoor units and the outdoor units calculated by the air conditioning capacity allocation calculating unit to each of the indoor units and the outdoor units.

Advantageous Effects of Invention

According to the present invention, an environment in a space can be controlled such that the environment agrees with an environment target in each zone, serving as a subspace of the space, set by the zone setting unit. Advantageously, if the space is not physically partitioned, the environment at each position in the space can be controlled to an environment set for the position.

DESCRIPTION OF EMBODIMENTS

Embodiment 1

Figure 1:
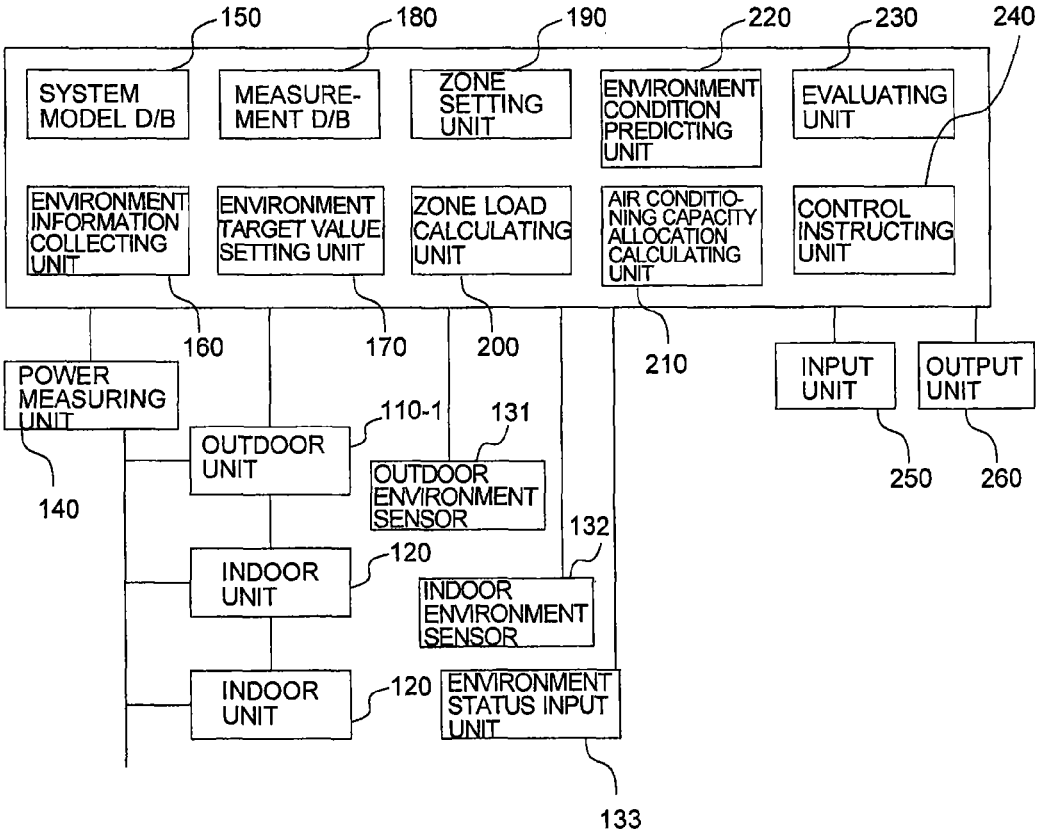
FIG. 1 is a diagram illustrating the configuration of an air-conditioning control device according to Embodiment 1 of the present invention and the configuration of an air-conditioning unit system.
Figure 2:
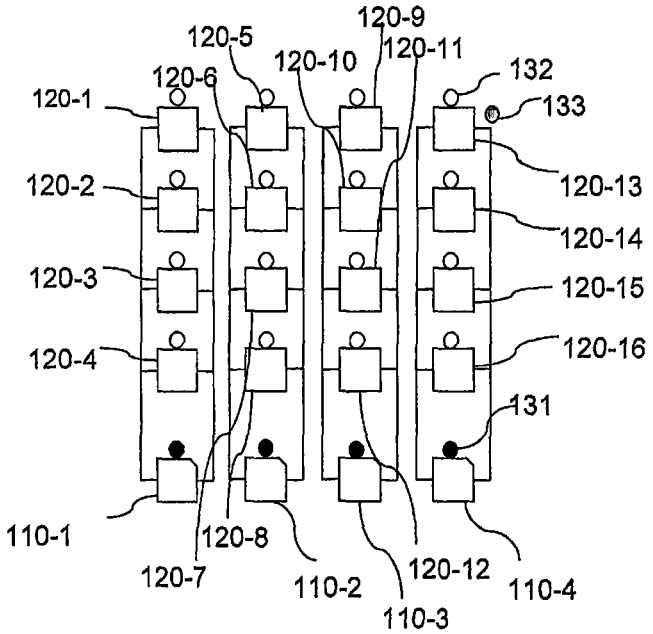
FIG. 2 includes diagrams each illustrating the relationship between outdoor units, indoor units, indoor environment sensors, and outdoor environment sensors arranged inside and outside a space in Embodiment 1 of the present invention.
Figure 2:
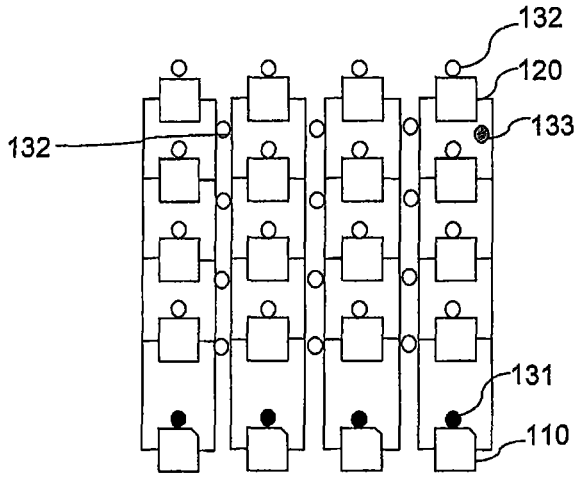
Figure 3:
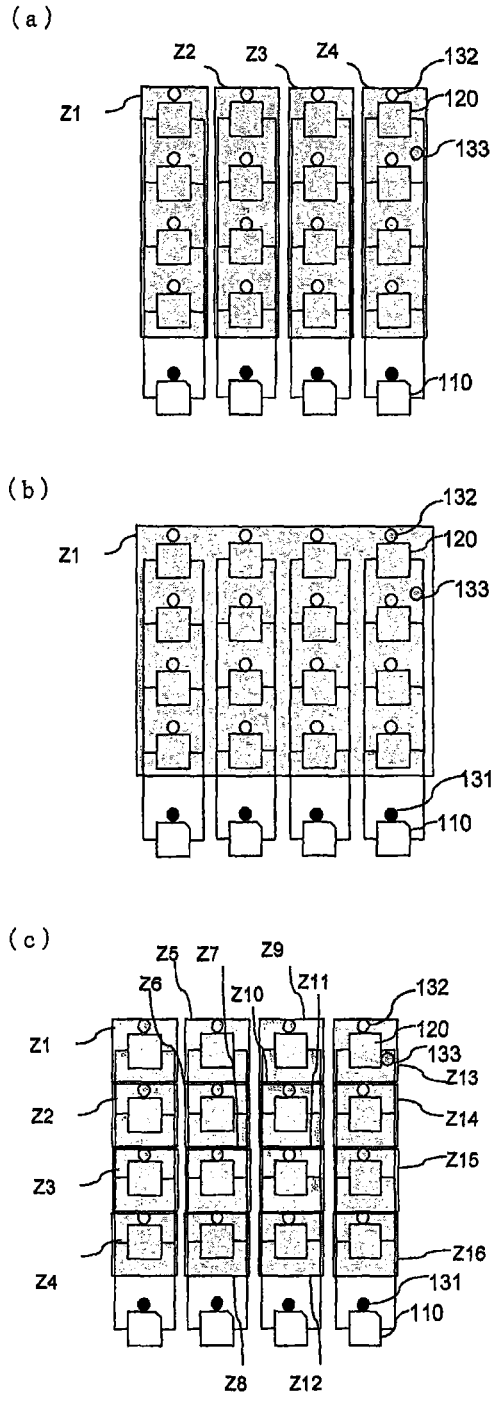
FIG. 3 includes diagrams each illustrating the relationship between indoor units 120, outdoor units 110, and zones in Embodiment 1 of the present invention.
Figure 4:
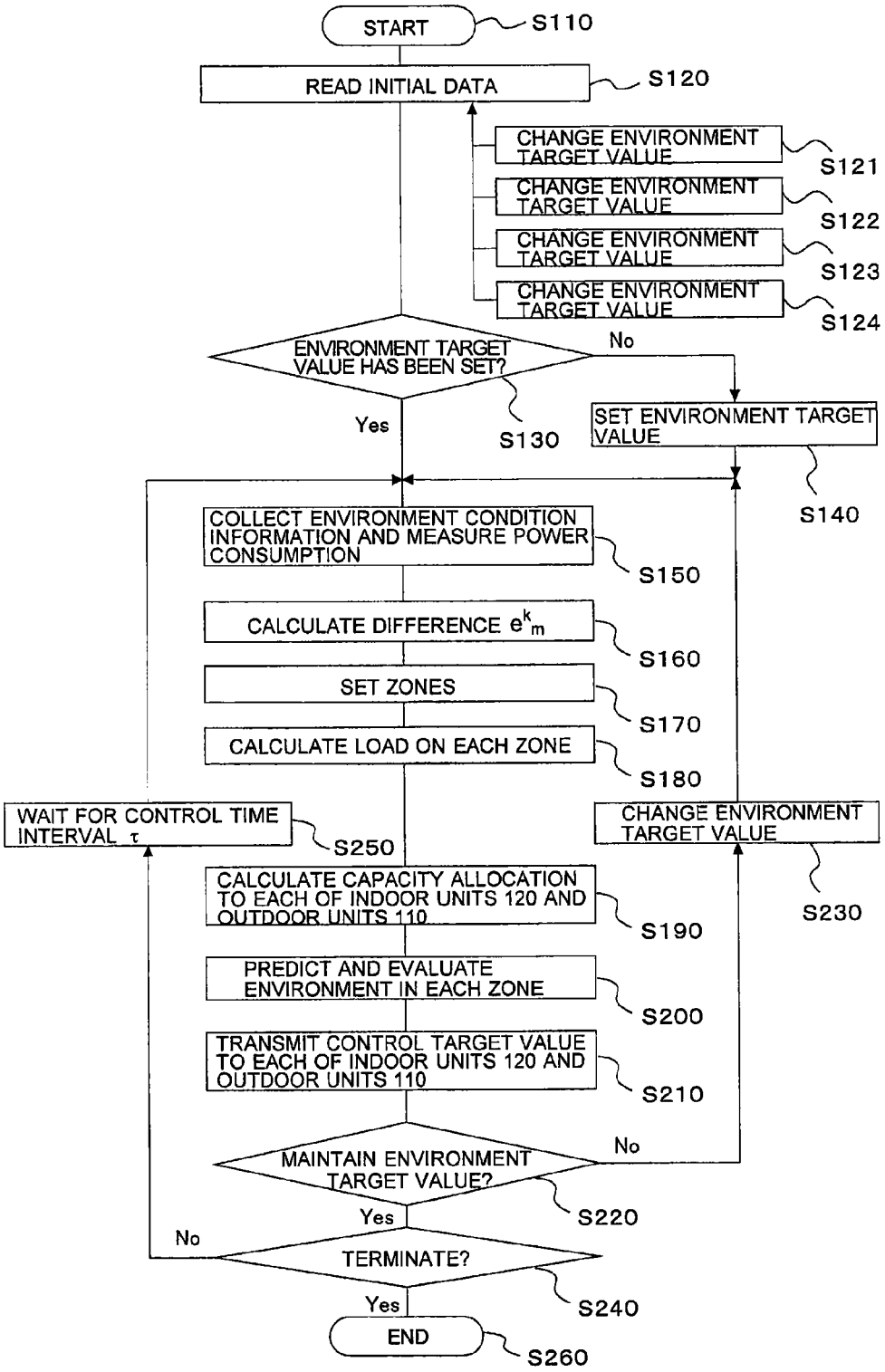
FIG. 4 is a flowchart illustrating a process for control by the air-conditioning control device according to Embodiment 1 of the present invention.

FIGS. 1 to 4 are diagrams for explaining the outline of an air-conditioning control device according to Embodiment 1 of the present invention. FIG. 1 is a diagram illustrating the configuration of the air-conditioning control device according to Embodiment 1 of the present invention and the configuration of an air-conditioning unit system. FIG. 2 includes diagrams each illustrating the relationship between outdoor units, indoor units, indoor environment sensors, and outdoor environment sensors arranged inside and outside a space in Embodiment 1 of the present invention. FIG. 3 includes diagrams each illustrating the relationship between the indoor units and zones in Embodiment 1 of the present invention. FIG. 4 is a flowchart illustrating a process for control by the air-conditioning control device according to Embodiment 1 of the present invention. The air-conditioning control device according to Embodiment 1 will be described with reference to these figures.

FIG. 1 illustrates the configuration of the air-conditioning control device according to Embodiment 1 of the present invention and the configuration of the air-conditioning unit system. As illustrated in FIG. 1, the air-conditioning unit system, which is a target to be controlled by the air-conditioning control device according to Embodiment 1, includes a plurality of outdoor units 110 and a plurality of indoor units 120. Each outdoor unit 110 is connected by pipes to one or more indoor units 120, thus providing a refrigerant circuit through which a refrigerant is circulated. In Embodiment 1, for example, the refrigerant circuits equal in number to the outdoor units 110 are arranged. Each outdoor unit 110 includes, for example, a compressor and an outdoor heat exchanger (which are not illustrated) and performs heat supply for air conditioning in the indoor units 120. Each indoor unit 120 includes an indoor heat exchanger and an expansion device, such as an expansion valve, (which are not illustrated) and conditions air in a space by heat exchange between the air and the refrigerant.

An outdoor environment sensor 131, serving as outdoor environment condition detecting means, is installed on or near each outdoor unit 110 and detects a physical quantity around the outdoor unit 110 as an environment condition. An indoor environment sensor 132, serving as indoor environment condition detecting means, is installed in an air-conditioned space (hereinafter, referred to as a "space") and detects a physical quantity in an installation position as an environment condition. In Embodiment 1, the indoor environment sensor 132 is installed on or near each of the indoor units 120 and detects an environment condition. An environment status input unit 133 receives data indicating an environment status other than, for example, the physical quantity detected by each indoor environment sensor 132. Examples of the environment status include temperature, humidity, the concentration of carbon dioxide, and airflow. The relationship between the outdoor units 110, the indoor units 120, the outdoor environment sensors 131, the indoor environment sensors 132, and the environment status input unit 133 will be described later.

A power measuring unit 140 measures the amount of electric power consumed by each of the outdoor units 110 and the indoor units 120.

In the air-conditioning control device, a system model database (D/B) 150 stores data necessary for processing the air-conditioning unit control system. Examples of the data stored in the system model D/B 150 include data indicating a connection relationship between the outdoor units 110 and the indoor units 120, a correspondence relationship between the outdoor units 110 and the outdoor environment sensors 131, a correspondence relationship between the indoor units 120 and the indoor environment sensors 132, an adjacency relationship between the indoor units 120, an adjacency relationship between the indoor environment sensors 132, a correspondence relationship between the indoor units 120 and zones, which will be described later, an adjacency relationship between the zones, a correspondence relationship between the zones and the indoor environment sensors 132, and a correspondence relationship between the zones and the environment status input unit 133, input-output characteristic model data about the outdoor unit 110, input-output characteristic model data about the indoor unit 120, an input-output relationship between devices, piping model data, external environment model data, environment status model data, and indoor space model data.

An environment information collecting unit 160 collects, as environment information, data concerning environment conditions detected by the outdoor environment sensors 131 and the indoor environment sensors 132 and data concerning an environment status from the environment status input unit 133. An environment target value setting unit 170 sets an environment-related target value, such as a target value to be compared with an environment condition detected by each indoor environment sensor 132, a degree of comfort, and power consumption, or changes setting. A measurement database (D/B) 180 stores data indicating measurements by the power measuring unit 140 and the data collected by the environment information collecting unit 160.

A zone setting unit 190 forms one or more groups of the indoor units 120 arranged in the space on the basis of a set reference, calculation, or the like, each of the groups including adjacent indoor units 120, forms one or more zones (subspaces) of the space in correspondence to the positions of the indoor units 120 of each of the groups, sets the correspondence (inclusion) relationship between the zones and the indoor units 120, and changes setting. A zone load calculating unit 200 calculates a load (heat load) on each zone on the basis of the environment target value set by the environment target value setting unit 170 and the environment information collected by the environment information collecting unit 160. An air conditioning capacity allocation calculating unit 210 calculates an allocation of capacity to each of the indoor units 120 and the outdoor units 110 on the basis of the loads on the zones and the data stored in the system model D/B 150. An environment condition predicting unit 220 predicts a future environment condition on the basis of the air conditioning loads and the operation capacity allocations calculated by the air conditioning capacity allocation calculating unit 210. An evaluating unit 230 evaluates the future environment condition predicted by the environment condition predicting unit 220. A control instructing unit 240 transmits a signal related to a control instruction to each of the indoor units 120 and the outdoor units 110 on the basis of a value calculated by the air conditioning capacity allocation calculating unit 210.

An input unit 250 serves as data input means through which, for example, a system user or the like sets an environment target value. An output unit 260 serves as data output means for outputting data indicating, for example, a value predicted by the environment condition predicting unit 220, environment information, power consumption, and an evaluated value.

The air-conditioning control device can be constructed only by dedicated components (hardware). The hardware typically includes arithmetic control means (computer, controller) centered on, for example, a central processing unit (CPU). A procedure or process performed by means included in the air-conditioning control device is programmed in advance to provide a program and the program is stored as software, firmware, or the like in, for example, a memory device. The arithmetic control means executes the program, thus allowing the units to perform the process.

FIG. 2 includes diagrams each illustrating the relationship between the outdoor units, the indoor units, the indoor environment sensors, and the outdoor environment sensors arranged inside and outside the space in Embodiment 1 of the present invention. FIG. 2 illustrates examples of the correspondence relationship between the outdoor environment sensors 131 and the outdoor units 110, examples of the correspondence relationship between the indoor environment sensors 132, the environment status input unit 133, and the indoor units 120, and examples of the adjacency relationship. As described above, each outdoor environment sensor 131 according to Embodiment 1 is disposed so as to correspond to the outdoor unit 110. The outdoor environment sensor 131 according to Embodiment 1 is capable of detecting at least a temperature (outdoor air temperature) as an environment status. Each indoor environment sensor 132 is disposed so as to correspond to the indoor unit 120. The indoor environment sensor 132 according to Embodiment 1 is capable of detecting, for example, a temperature and a humidity of air (inlet air) sucked into the indoor unit 120 and a temperature and a humidity of air (outlet air) discharged from the indoor unit 120, and a flow velocity of the outlet air. Although the indoor environment sensors 132 are arranged in one-to-one correspondence to the indoor units 120 in FIG. 2(*a*), the indoor environment sensors 132 may be arranged at other positions in the space so as to be apart from the indoor units as illustrated in, for example, FIG. 2(*b*). For example, when the number of indoor environment sensors 132 is greater than the number of indoor units 120 as illustrated in FIG. 2(*b*), an environment condition detected by the indoor environment sensor 132 nearest to a certain indoor unit 120 fundamentally corresponds to an environment condition in the indoor unit 120. The correspondence relationship can be set as appropriate because it may be affected by a shield or the like. Here, each environment sensor measured value is denoted by $s^k_m$, where k denotes the attribute of a physical quantity (temperature, humidity, or airflow) detected by, for example, the outdoor environment sensor 131 or the indoor environment sensor 132. The environment target value setting unit 170 sets an environment target value $o^k_m$ for each attribute. Embodiment 1 and Embodiment 2 will be described with respect to an example of the attribute of temperature. The environment status input unit 133 interpolates the indoor environment sensors 132. For example, the environment status input unit 133 transmits a signal including data indicating qualitative information, such as "hot", "slightly hot", "comfortable", "slightly cold", or "cold", in the space on the basis of, for example, an input indicating an environment status other than the environment conditions (physical quantities) detected by the indoor environment sensors 132. The environment status input unit 133 receives position information about the environment status, such as space area position information, surveillance camera position information, RFID-based position information, and position information obtained from devices connected to a wireless or wired network.

FIG. 3 includes diagrams each illustrating the relationship between the indoor units 120, the outdoor units 110, and the zones in Embodiment 1 of the present invention. FIG. 3(*a*) illustrates arrangement of zones set such that each zone includes one outdoor unit 110 and the indoor units 120 connected in parallel with the outdoor unit 110 by pipes. In this arrangement of zones for air conditioning, a load on each outdoor unit 110 can be optimized. FIG. 3(*b*) illustrates arrangement in which a single zone is set so as to include all of the indoor units 120 in the space. In this case, the space coincides with the zone and air conditioning is performed to achieve a single environment target in the space. In this zone arrangement for air conditioning, the power consumption can be minimized. FIG. 3(*c*) illustrates arrangement of zones set such that each zone includes the indoor unit 120. In this arrangement of zones for air conditioning, a load on the zone can be optimized for each of the indoor units 120.

FIG. 4 is a flowchart illustrating a process for control by the air-conditioning control device according to Embodiment 1 of the present invention. The process performed by the air-conditioning control device according to Embodiment 1 will be described with reference to FIG. 4.

After step S110 of activating the air-conditioning unit system is executed, step S120 of reading initial data is executed. Step S120 includes substep S121 of reading system configuration data from the system model D/B 150, substep S122 of reading the model data about the indoor units 120, the outdoor units 110, and piping, substep S123 of reading data concerning environment conditions detected by the outdoor environment sensors 131 and the indoor environment sensors 132 through the environment information collecting unit 160 and reading data indicating measurements by the power measuring unit 140, and substep S124 of reading data related to a power consumption limit during a predetermined time period from an external environment.

Subsequently, the environment target value setting unit 170 executes step S130 of determining whether an environment target value has been set. When determining that the environment target value has been set, the environment target value setting unit 170 executes step S150. On the other hand, when determining that any environment target value has not been set, the environment target value setting unit 170 executes step S140 of setting an environment target value. In step S150, environment information collected by the environment information collecting unit 160 and power data obtained by power measurements through the power measuring unit 140 are stored into the measurement D/B 180.

Subsequently, step S160 of calculating the difference, $e^k_m$, between the environment target value $o^k_m$ and each environment sensor measured value $s^k_m$ as expressed by Expression (1) is executed.

[Math. 1]

$$e^k_m = o^k_m - s^k_m \tag{1}$$

Then, the zone setting unit 190 executes step S170 of performing processing of setting a zone Z. For example, the zone may initially be set for each of the indoor units 120 in the space as illustrated in FIG. 3(*c*). The zones may be changed by, for example, merging. Subsequently, the zone load calculating unit 200 executes step S180 of estimating a load on each zone on the basis of the difference between the environment target value and each environment sensor measured value and the present load. Then, the air conditioning capacity allocation calculating unit 210 executes step S190 of calculating an allocation of operation capacity to each of the indoor units 120 and the outdoor units 110. Furthermore, the environment condition predicting unit 220 and the evaluating unit 230 execute step S200 of predicting and evaluating an environment in each zone. In step S200, as described above, the environment condition predicting unit 220 predicts a time period and energy consumption to reach a target environment. The output unit 260 outputs (for example, displays) results of prediction. The control instructing unit 240 executes step S210 of transmitting a signal including data indicating a control target value to each of the outdoor units 110 and the indoor units 120 on the basis of the operation capacity allocation calculated in step S190 by the air conditioning capacity allocation calculating unit 210.

Subsequently, the environment target value setting unit 170 executes step S220 of determining whether to maintain the environment target. When determining not to maintain the environment target, the environment target value setting unit 170 executes step S230 of changing the environment target. When the environment target is changed, the process returns to step S150 and the subsequent steps are executed.

If it is determined that the environment target is maintained, step S240 of determining whether the input unit 250 has received a termination instruction to terminate the operation of the air-conditioning unit system is executed. If it is determined that any termination instruction has not been received, step S250 of waiting only for a control time interval τ is executed. Then, the process returns to step S150 and the subsequent steps are executed. On the other hand, if it is determined that the termination instruction has been received, step S260 of terminating the process is executed.

Setting of the zones will now be described with reference to FIG. 3 described above. FIG. 3(*a*) illustrates the case where the indoor units 120 connected by pipes to each outdoor unit 110 belong to one zone. In this case, indoor units 120-1 to 120-4 which belong to a zone $Z_1$ can be expressed by Expression (2), where each ACI denotes the indoor unit 120.

[Math. 2]

$$\{ACI_1, ACI_2, ACI_3, ACI_4\} \in Z_1 \tag{2}$$

FIG. 3(*b*) illustrates the case where all of the indoor units 120-1 to 120-16 belong to the single zone $Z_1$, which can be expressed by Expression (3).

[Math. 3]

$$\{ACI_1, ACI_2, ACI_{16}\} \in Z_1 \tag{3}$$

FIG. 3(*c*) illustrates the case where the zones correspond one-to-one to the indoor units 120. In this case, when the indoor units 120-*j* (j=1, 2, 3, 4, . . . , 16) correspond to the respective zones i (i=1, 2, 3, 4, . . . , 16), the relationship between the indoor unit 120-*j* and the zone $Z_i$ is expressed by Expression (4).

[Math. 4]

$$\{ACI_1\} \in Z_1 \tag{4}$$

Furthermore, the relationship between the indoor units 120 and the outdoor units 110 illustrated in FIG. 3 is expressed using the indoor units 120-*j* (i=1, 2, 3, 4, . . . , 16) and the outdoor units 110-*k* (k=1, 2, 3, 4) by Expressions (5) to (8) as follows.

[Math. 5]

$$\{ACI_1, ACI_2, ACI_3, ACI_4\} \in ACO_1 \tag{5}$$

[Math. 6]

$$\{ACI_5, ACI_6, ACI_7, ACI_8\} \in ACO_2 \tag{6}$$

[Math. 7]

$$\{ACI_9, ACI_{10}, ACI_{11}, ACI_{12}\} \in ACO_3 \tag{7}$$

[Math. 8]

$$\{ACI_{13}, ACI_{14}, ACI_{15}, ACI_{16}\} \in ACO_4 \tag{8}$$

The load calculation performed in step S180 by the zone load calculating unit 200 will now be described. The load on each zone is obtained from the sum of heat outputs of the indoor units 120 belonging to the zone as expressed by Expression (9) where i denotes the zone number, $L_i$ denotes the load for the zone number i, $H^{ACI}_j$ denotes heat output which can be expressed on the basis of a heat output function of the indoor unit 120-*j* expressed by Expression (10), where $TI_j$ denotes the temperature of outlet air, $TO_j$ denotes the temperature of inlet air, $HO_j$ denotes the humidity of inlet air, and $WF_j$ denotes the amount of outlet air.

[Math. 9]

$$L_i = \sum_{j \in Z_i} H^{ACI}_j \tag{9}$$

[Math. 10]

$$H^{ACI}_j = H^{ACI}(TI_j, TO_j, HO_J, WF_j) \tag{10}$$

A method of operation capacity allocation to each of the outdoor units 110 and the indoor units 120 calculated in step S190 by the air conditioning capacity allocation calculating unit 210 will now be described. Each of the capacity allocated to each outdoor unit 110 and the capacity allocated to each of the indoor units 120 can be obtained as a solution of an optimization problem formulated as Expressions (11) to (16). The power consumption, E, of the entire air-conditioning unit system can be expressed by Expression (11). The power consumption of each of the outdoor units 110 and the indoor units 120 is calculated so as to satisfy Expressions (12) to (16), serving as constraint expressions, and minimize the power consumption E expressed by Expression (11) and the capacity is allocated on the basis of the power consumptions. In the following expressions, $E^{ACO}_k$ denotes the power consumption of the outdoor unit 110-*k*, $E^{ACI}_j$ denotes the power consumption of the indoor unit 120-*j*, i denotes the zone number, $L_i$ denotes the load for the zone number i, $H^{ACI}_j$ denotes the heat output of the outdoor unit 110-*k*, $E^{ACO}_k(H^{ACO}_k, T^O)$ denotes the power consumption of the outdoor unit 110-*k* with a heat output $H^{ACO}_k$ of the outdoor unit k at an outdoor air temperature $T^O$, and $E^{ACI}_j(WF_j)$ denotes the power consumption of the indoor unit 120-*j* at the outlet air amount $WF_j$.

[Math. 11]

$$\sum_{k \in ACO} E_k^{ACO} + \sum_{j \in ACI} E_j^{ACI} \tag{11}$$

[Math. 12]

$$L_i = \sum_{j \in Z_i} H_j^{ACI} \ (\forall\, i \in Z) \tag{12}$$

[Math. 13]

$$H_j^{ACI} = H^{ACI}(TI_j, TO_j, HO_J, WF_j) \ (\forall\, j \in ACO) \tag{13}$$

[Math. 14]

$$H_k^{ACO} = \sum_{j \in ACO_k} H_j^{ACI} \ (\forall\, k \in ACO) \tag{14}$$

[Math. 15]

$$E_k^{ACO} = E_k^{ACO}(H_k^{ACO}, T^O)(\forall\, k \in ACO) \tag{15}$$

[Math. 16]

$$E_j^{ACI} = E_j^{ACI}(WF_j)(\forall\, j \in ACI) \tag{16}$$

For the solution of the optimization problem, it is preferred to use a solution appropriate to the objective function as Expression (11) and the constraints as Expressions (12) to (16). For example, when the objective function and the constraints are linear functions, the simplex method, the interior point method, or the like can be used. When the objective function and the constraints are quadratic functions, the interior point method, Lagrange's method of undetermined multipliers, or the like can be used. When the objective functions and the constraints are cubic functions or higher-order functions, the sequential quadratic programming or a metaheuristic-based solution, such as particle swarm optimization (PSO), differential evolution (DE), or real-coded genetic algorithm (real-coded GA), can be used.

As described above, the air-conditioning unit control device according to Embodiment 1 includes the zone setting unit 190 and can perform control so that an environment in each of zones, obtained by dividing the space, agrees with the target environment. Consequently, for example, if the space is not physically partitioned, the environment at each position in the space can be controlled to a target environment set for the position. In this case, each of the indoor units 120 and the outdoor units 110 is operated in accordance with the operation capacity allocation determined on the basis of the difference between the environment target value and each environment condition value by the air conditioning capacity allocation calculating unit 210, so that the energy consumption can be reduced while the environment target is achieved. Thus, energy saving can be achieved. In addition, since the space is not physically partitioned, the indoor units 120 in the space are operated in cooperation with one another to enhance the efficiency of operation, thus achieving energy saving, power saving, and the like of the air-conditioning unit system. Furthermore, for example, the environment target value setting unit 170 changes a plurality of environment targets at the same time, alternatively, changes some of environment target values depending on time period, thus achieving other environment targets, such as energy saving and power saving.

Embodiment 2

Figure 5:
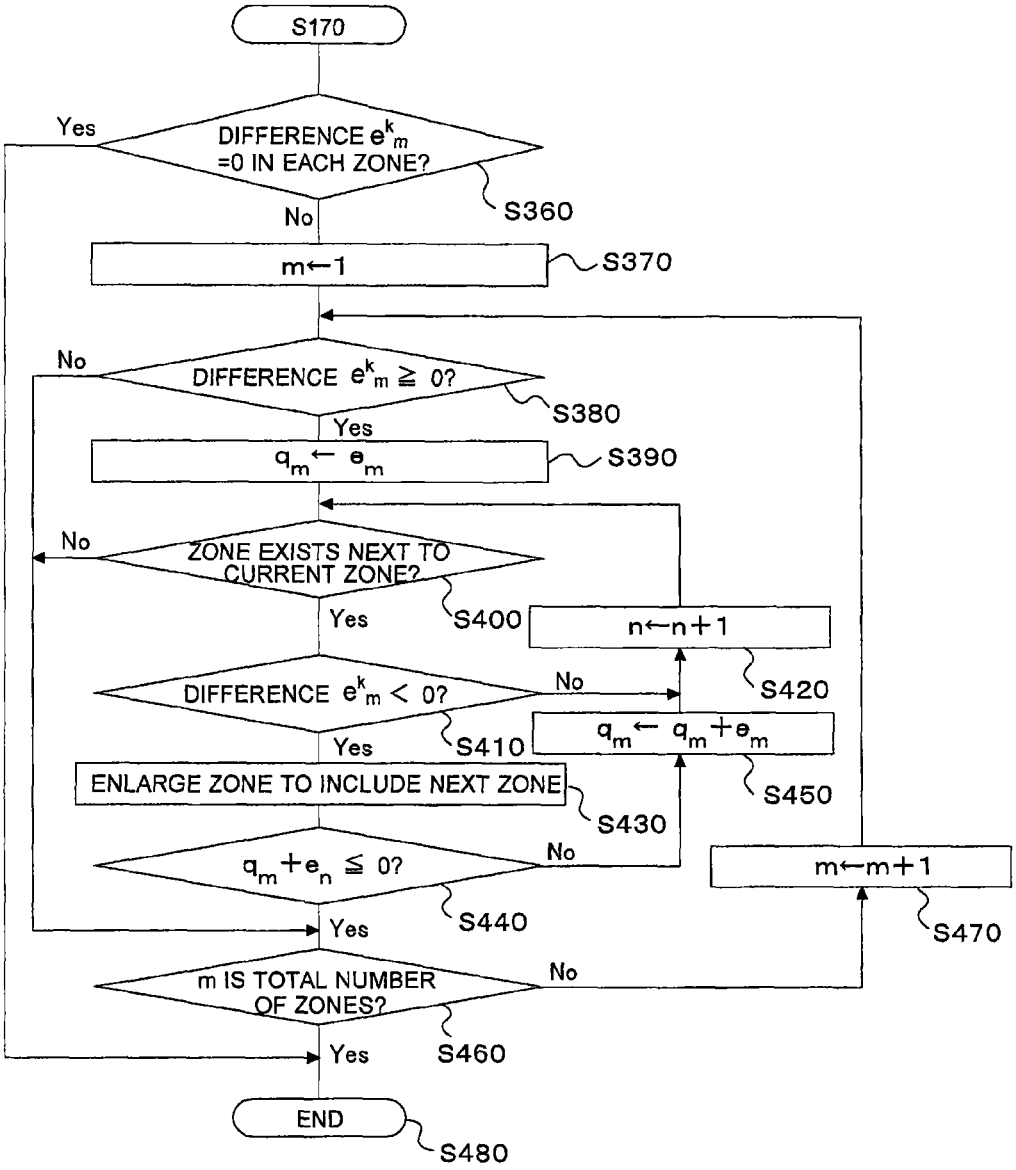
FIG. 5 is a flowchart illustrating a process for setting or changing a zone in Embodiment 2 of the present invention.

FIG. 5 is a flowchart illustrating a process for setting or changing the zones in Embodiment 2 of the present invention. Embodiment 2 will be described with respect to the process of setting or changing the zones, the process being performed by the zone setting unit 190 in Embodiment 1. The configuration of the air-conditioning unit system, that of the air-conditioning unit control device, and the like in Embodiment 2 are the same as those in Embodiment 1.

First, step S360 of determining whether the difference $e^k_m$ between the environment target value $o^k_m$ and the environment sensor measured value $s^k_m$, as expressed by Expression (1), is equal to 0 in each zone Z is executed. When there are a plurality of environment sensor measured values $s^k_m$ in the zone Z, calculation is performed using a median value, a mean value, or the like. If it is determined that $e^k_m=0$ in each zone Z, step S480 of terminating the process is executed. On the other hand, if it is determined that there is a zone Z in which the difference $e^k_m$ is not equal to 0, step S370 of initializing m to 1 is executed. The following steps S380 to S460 are repeatedly executed until m is equal to the total number of zones Z. In this case, $e^k_m=0$ means that $|e^k_m|$ is a value $\epsilon$ close to zero ($|e^k_m|<\epsilon$, $\epsilon$ is a predetermined value).

Step S380 of determining whether the difference $e^k_m$ between the environment target value $o^k_m$ and the environment sensor measured value $s^k_m$ in the zone $Z_m$ is greater than or equal to 0 is executed. If it is determined that the difference $e^k_m$ is not greater than or equal to 0 (i.e., it is less than 0), step S460 of determining whether m is equal to the total number of zones Z (or whether all of the zones Z have been subjected to the process) is executed. If it is determined that m is not equal to the total number of zones Z, step S470 of increasing m by one is executed and step S380 is executed for the next zone Z. On the other hand, if it is determined that the difference $e^k_m$ is greater than or equal to 0, step S390 of substituting $e^k_m$ for $q^k_m$ is executed.

Subsequently, step S400 of determining whether there is a zone $Z_n$ next to the zone $Z_m$ is executed. If it is determined that there is the next zone $Z_n$, step S410 of determining whether the difference $e^k_n$ between an environment target value $o^k_n$ and an environment sensor measured value $s^k_n$ in the zone $Z_n$ is less than 0 is executed. When there are a plurality of environment sensor measured values $e_n$, calculation is performed using a median value, a mean value, or the like. On the other hand, if it is determined that there is the next zone $Z_n$, step S460 is executed.

If it is determined in step S410 that the difference $e^k_n$ is greater than or equal to 0, step S420 of increasing n by one is executed. The process then returns to step S400. On the other hand, if it is determined that $s^k_m$ is less than $s^k_n$ and the difference $e^k_n$ is less than 0, step S430 of enlarging the range of the zone $Z_m$ such that the zone $Z_m$ includes the next zone $Z_m$ is executed. Then, step S440 of determining whether the sum $p^k_n$ of $q^k_m$ and $e^k_n$ is less than or equal to 0 is executed. If it is determined that the sum $p^k_n$ is not less than or equal to 0 (i.e., it is greater than 0), the sum $p^k_n$ is set to a new $q^k_m$. The process then returns to step S420. On the other hand, if it is determined that the sum $p^k_n$ is less than or equal to 0, the above-described step S460 is executed. If it is determined that all of the zones Z have been subjected to the process, step S480 of terminating the process is executed. If it is determined that all of the zones Z have not been subjected to the process, step S380 is executed for the next zone Z.

Figure 6:
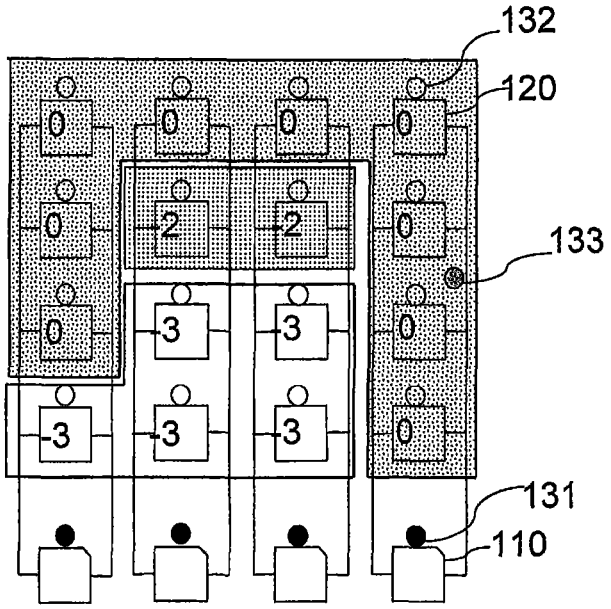
FIG. 6 is a diagram for explaining a zone setting process performed by a zone setting unit 190 in Embodiment 2 of the present invention.

FIG. 6 is a diagram for explaining the zone setting process performed by the zone setting unit 190 in Embodiment 2 of the present invention. In this case, the indoor units 120 in the space are categorized on the basis of the difference $e^k_m$ between the environment target value $o^k_m$ and each environment sensor measured value $s^k_m$ and a threshold value. The zones are set such that adjacent indoor units 120 belonging to the same category belong to the same zone. The zones are set such that the indoor units 120 with the same difference $e^k_m$ between the environment target value $o^k_m$ and the environment sensor measured value $s^k_m$ belong to the same group, so that the same load can be applied (or the same capacity is allocated) to adjacent indoor units 120.

As described above, the zone setting is changed in the air-conditioning unit control device according to Embodiment 2 so that a zone including the indoor units 120 having sufficient capacity cooperates with a zone which includes the indoor units 120 having insufficient capacity, for example, in which the environment does not achieve an environment target value. Accordingly, the capacity is shifted from the indoor units 120 having sufficient capacity to the indoor units 120 having insufficient capacity, so that the environment in the zone including the indoor units 120 having insufficient capacity can be brought close to the environment target while the power consumption of the entire system is limited.

Embodiment 3

Figure 7:
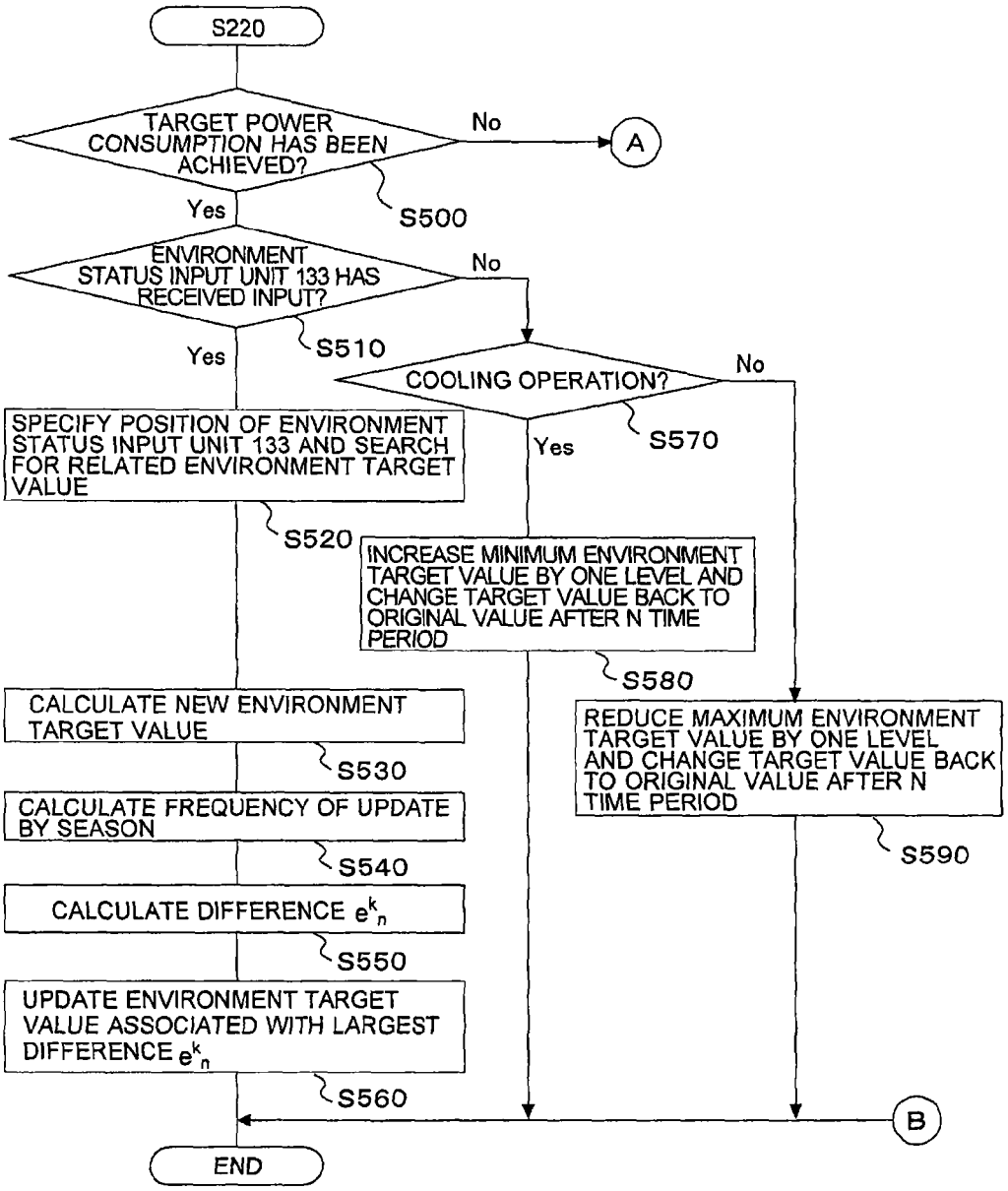
FIG. 7 is a (first) flowchart illustrating a process performed by an environment target value setting unit 170 in Embodiment 3 of the present invention.
Figure 8:
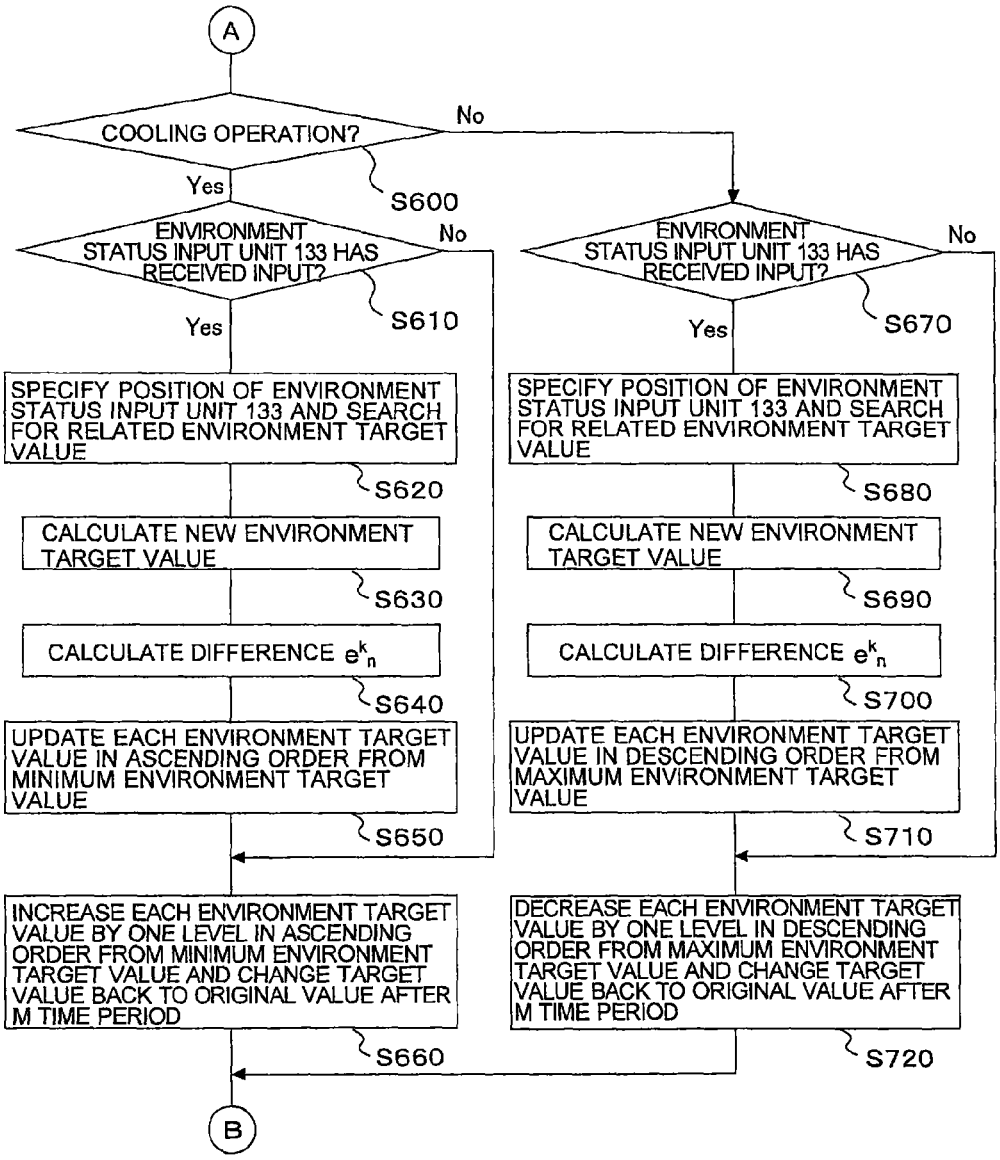
FIG. 8 is a (second) flowchart illustrating the process performed by the environment target value setting unit 170 in Embodiment 3 of the present invention.

FIGS. 7 and 8 are flowcharts illustrating a process of the environment target value setting unit 170 in Embodiment 3 of the present invention. Embodiments 1 and 2 have been described on the assumption that the environment status and the environment target value indicate temperature, a single kind. The environment target, however, is not limited to a single kind. For example, assuming that a target value of power consumption is set, if the power consumption target value is small, a temperature in a target space (zone) may fail to physically agree with an environment target value. In this case, which environment target should be achieved becomes a problem. Embodiment 3 will be described with respect to an environment target changing process performed by the environment target value setting unit 170.

This process corresponds to, for example, processing in step S230 in FIG. 4 described in Embodiment 1. For example, if it is determined in step S220 that the target value is not maintained when one of the set environment targets cannot be continuously achieved, when the power consumption target value cannot be achieved, or when the environment status input unit 133 receives a new input, step S230 is executed.

First, step S500 of determining whether the environment target for power consumption has been achieved is executed. If it is determined that this environment target has been achieved, step S510 of determining whether the environment status input unit 133 has received an input is executed. If it is determined that the environment status input unit 133 has received an input, step S520 of specifying the position of the environment status input unit 133 and searching for a related environment target is executed.

Furthermore, step S530 of calculating a new environment target value on the basis of the environment status input value, the environment target value, and the environment sensor measured value is executed. For example, it is assumed that the input received by the environment status input unit 133 indicates "slightly hot (−0.5 degrees C.). When the environment target value is 29 degrees C. and the environment sensor measured value is 30 degrees C., the new environment target value is set to 28.5 degrees C. (=29−0.5). As regards a typical environment target, it is assumed that 25?29 degrees C. is set for cooling and 18?22 degrees C. is set for heating. In this case, "hot (−1 degree C.)", "slightly hot (−0.5 degrees C.)", "comfortable (0 degrees C.)", "slightly cold (+0.5 degrees C.)", and "cold (+1 degree C.)" are set as initial values. Although the relationship between temperature levels is maintained, the temperatures are not limited to these values.

Subsequently, step S540 of calculating the frequency of update by season set for each of the environment target values associated with the indoor environment sensors 132 is executed. The frequency of update is, for example, five updates when the environment target value associated with the indoor environment sensor 132-*j* is 27 degrees C., ten updates when it is 28 degrees C., or 20 updates when it is 29 degrees C. The frequency of update by season is reference data used to set each environment target value at, for example, the beginning of each season. Furthermore, step S550 of calculating the difference $e^k_m$ between the updated environment target value $o^k_m$ and each environment sensor measured value $s^k_m$ is executed. Then, step S560 of updating the environment target value $o^k_m$ associated with the largest difference $e^k_m$ is executed. The process of changing the environment target value is then terminated.

On the other hand, if it is determined in step S510 that the environment status input unit 133 has not received any input, step S570 of determining whether the air-conditioning unit system is in a cooling mode operation is executed. If it is determined that it is the cooling mode operation, step S580 of specifying a minimum environment target value and increasing the environment target value by one level is executed. The environment target value changing process is then terminated. In this case, the updated environment target value is returned to its original value after N time period (predetermined time period). On the other hand, if it is determined that the system is not in the cooling mode operation, step S590 of specifying a maximum environment target value and reducing the environment target value by one level is executed. The environment target value changing process is then terminated. The updated environment target value is also returned to its original value after N time period (predetermined time period).

Furthermore, if it is determined in step S500 that the power consumption environment target has not been achieved, step S600 of determining whether the air-conditioning unit system is in the cooling mode operation is executed. If it is determined that the system is in the cooling mode operation, step S610 of determining whether the environment status input unit 133 has received any input is executed. If it is determined that the environment status input unit 133 has received any input, step S620 of specifying the position of the environment status input unit 133 and searching for a related environment target is executed. Furthermore, step S630 of calculating a new environment target value on the basis of the environment status input value, the environment target value, and the environment sensor measured value is executed. The method of calculation is the same as that in step S530 described above.

Subsequently, step S640 of calculating the difference $e^k_m$ between the calculated environment target value $o^k_m$ and each environment sensor measured value $s^k_m$ is executed. Then, step S650 of updating each environment target value $o^k_m$ in ascending order from the minimum environment target value until the power consumption target value is achieved, alternatively, all of the environment target values are updated is executed. Furthermore, step S660 of increasing each environment target value by one level in ascending order from the minimum environment target value until the power consumption target value is achieved, alternatively, all of the environment target values are updated is executed. The environment target value changing process is then terminated. In this case, each updated environment target value is returned to its original value after M time period (predetermined time period).

If it is determined in step S610 that the environment status input unit 133 has not received any input, step S660 is executed. The environment target value changing process is then terminated.

On the other hand, if it is determined in step S600 that the system is not in the cooling mode operation, step S670 of determining whether the environment status input unit 133 has received any input is executed. If it is determined that the environment status input unit 133 has received any input, step S680 of specifying the position of the environment status input unit 133 and searching for a related environment target is executed. Furthermore, step S690 of calculating a new environment target value on the basis of the environment status input value, the environment target value, and the environment sensor measured value is executed. For example, it is assumed that the environment status input unit 133 has received an input indicating "slightly hot (−0.5 degrees C.)". When the environment target value is 21 degrees C. and the environment sensor measured value is 21 degrees C., the new environment target value is set to 20.5 degrees C. (=21−0.5).

Subsequently, step S700 of calculating the difference $e^k_m$ between the calculated environment target value $o^k_m$ and each environment sensor measured value $s^k_m$ is executed. Then, step S710 of updating each environment target value $o^k_m$ in descending order from the maximum environment target value until the power consumption target value is achieved, alternatively, all of the environment target values are updated is executed. Furthermore, step S720 of reducing each environment target value by one level in descending order from the maximum environment target value until the power consumption target value is achieved, alternatively, all of the environment target values are updated is executed. The environment target value changing process is then terminated. In this case, each updated environment target value is returned to its original value after M time period (predetermined time period).

To achieve the power consumption environment target with reliability, the operation capacity of each of the outdoor units 110 and the indoor units 120 is determined using Expressions (17) to (24) instead of Expressions (11) to (16). In the following expressions, $es^k_m$ denotes a predicted value of the environment sensor measured value of the environment sensor m, $ES^k_m(H^{ACI}_m, s^k_m)$ denotes a prediction function of the environment sensor measured value at the next measurement time with an output heat amount $H^{ACI}_m$ of the indoor unit 120 and the environment sensor measured value $s^k_m$, and $w_m$ denotes the weight assigned to each environment target m. For example, as the environment target value $o^k_m$ for cooling is larger, $w_m$ is set to a larger value. The weight is set in consideration of the environment targets of the entire system.

[Math. 17]

$$\sum_m w_m(o^k_m - es^k_m)^2 \tag{17}$$

[Math. 18]

$$\sum_{k\in ACO} E^{ACO}_k + \sum_{j\in ACI} E^{ACI}_j \le E^{max} \tag{18}$$

[Math. 19]

$$L_i = \sum_{j\in Z_i} H^{ACI}_j \ (\forall\, i \in Z) \tag{19}$$

[Math. 20]

$$H^{ACI}_j = H^{ACI}(TI_j, TO_j, HO_J, WF_j)(\forall\, j \in ACI) \tag{20}$$

[Math. 21]

$$H^{ACO}_k = \sum_{j\in ACO_k} H^{ACI}_j \ (\forall\, k \in ACO) \tag{21}$$

[Math. 22]

$$E^{ACO}_k = E^{ACO}_k(H^{ACO}_k, T^O)(\forall\, k \in ACO) \tag{22}$$

[Math. 23]

$$E^{ACI}_j = E^{ACI}_j(WF_j)(\forall\, j \in ACI) \tag{23}$$

[Math. 24]

$$es^k_j = ES^k_j(H^{ACI}_j, s^k_j)(\forall\, j \in ACI) \tag{24}$$

As described above, the air-conditioning unit control device according to Embodiment 3 dynamically changes the environment target value depending on the degree of achievement of the environment target and an input indicating a set status of an environment target received through the environment status input unit 133, for example, when the power consumption environment target has not been achieved, alternatively, when a request from a person in the space is intended to be reflected. Advantageously, the environment target value can be appropriately corrected and the power consumption environment target can be achieved. For example, if any cause results in overcooling or the like, such a problem can be overcome.

Embodiment 4

According to the above-described method in Embodiment 2, the zone is enlarged to include the next zone, thereby changing zone setting. Thus, the capacity is shifted from the indoor units 120 having sufficient capacity to the indoor units 120 having insufficient capacity to bring the environment in the zone including the indoor units 120 having insufficient capacity close to a target environment while limiting the power consumption of the entire system.

According to Embodiment 4, one or more adjacent indoor units 120 having insufficient capacity are grouped together to form and set a new zone. The new zone is set so as to overlap existing zones. Thus, the capacity is shifted from the indoor units 120 having sufficient capacity to the indoor units 120 in the new zone to bring an environment in the zone including the indoor units 120 having insufficient capacity close to a target environment while limiting the power consumption of the entire system. Embodiment 4 will be described with reference to FIGS. 9, 10, and 11.

Figure 9:
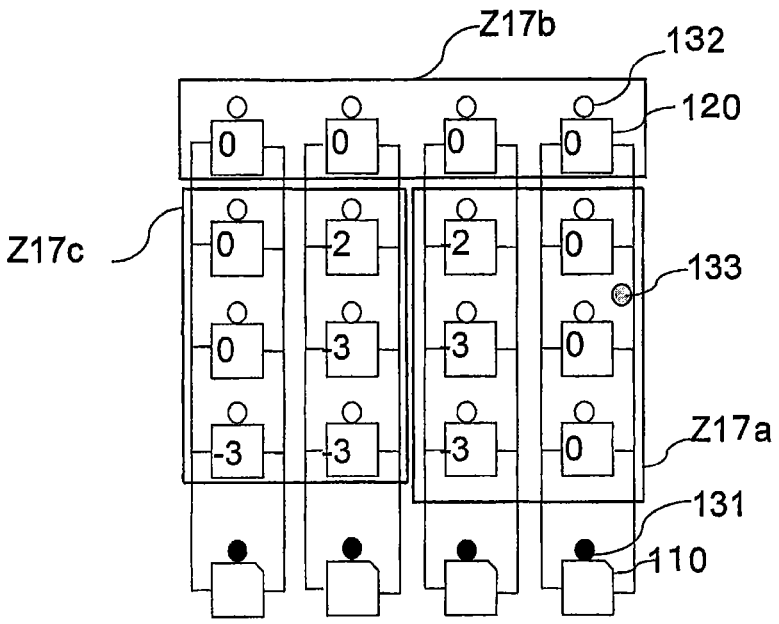
FIG. 9 is a (first) diagram for explaining a process performed by the zone setting unit 190 and an air conditioning capacity allocation calculating unit 210 in Embodiment 4 of the present invention.
Figure 10:
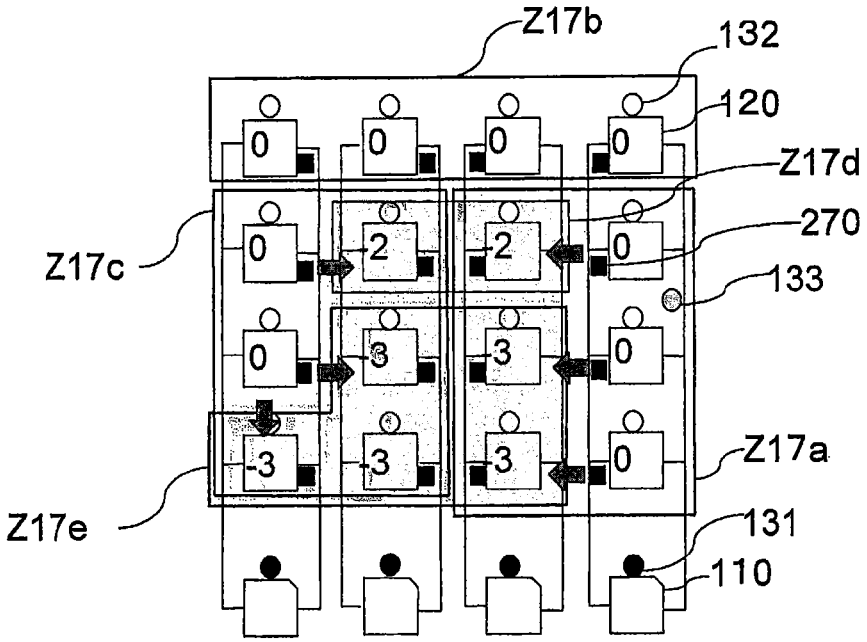
FIG. 10 is a (second) diagram for explaining the process performed by the zone setting unit 190 and the air conditioning capacity allocation calculating unit 210 in Embodiment 4 of the present invention.

FIGS. 9 and 10 are diagrams for explaining a process performed by the zone setting unit 190 and the air conditioning capacity allocation calculating unit 210 in Embodiment 4 of the present invention. FIG. 9 illustrates an exemplary zone setting in which the indoor units 120 are grouped into zones Z17a, Z17b, and Z17c.

Figure 11:
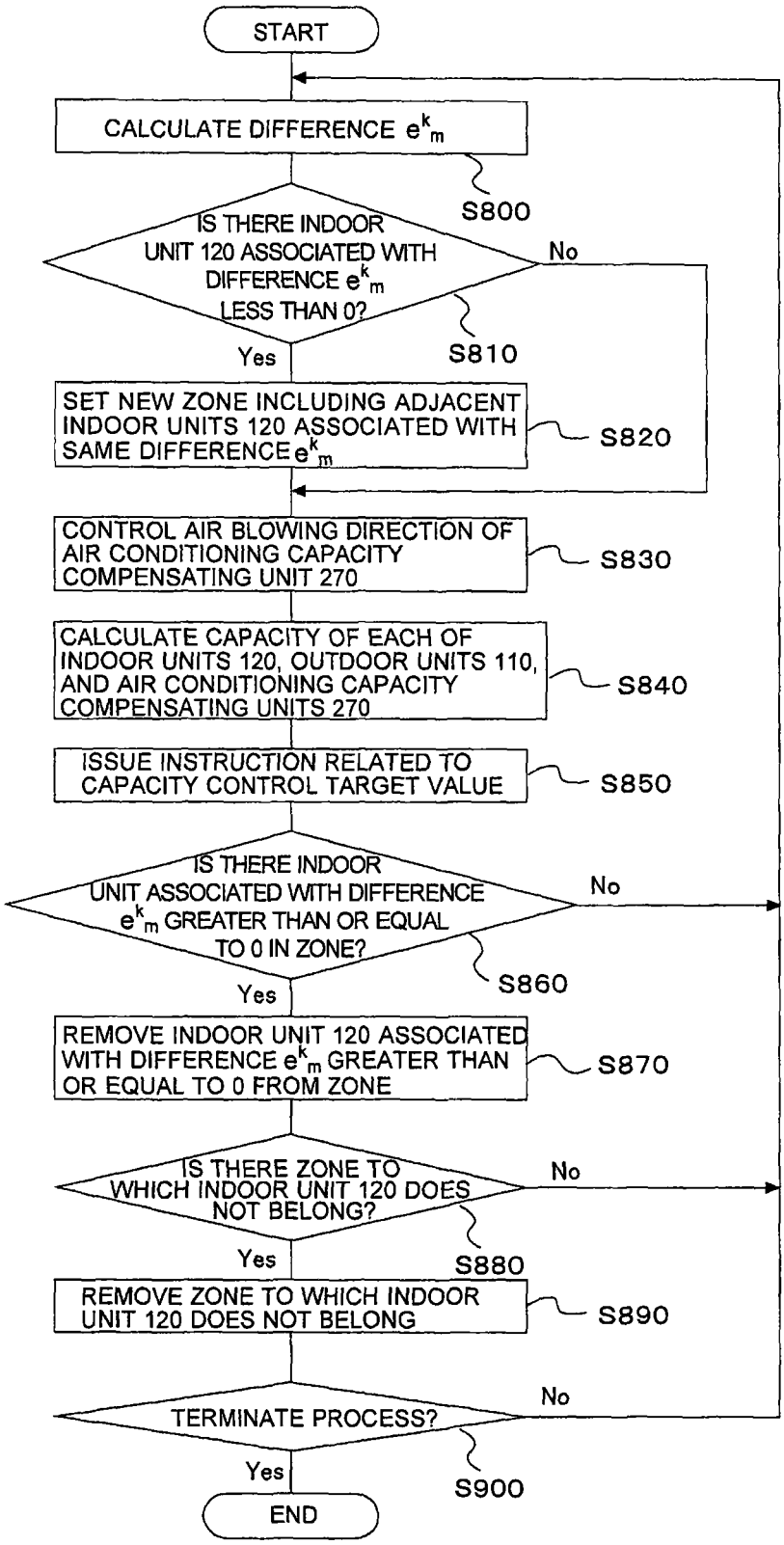
FIG. 11 is a flowchart illustrating the process performed by the zone setting unit 190 and the air conditioning capacity allocation calculating unit 210 in Embodiment 4 of the present invention.

FIG. 11 is a flowchart illustrating the process performed by the zone setting unit 190 and the air conditioning capacity allocation calculating unit 210 in Embodiment 4 of the present invention. First, the zone setting unit 190 executes step S800 of calculating the difference $e^k_m$ between the environment target value $o^k_m$ and each environment sensor measured value $s^k_m$. Subsequently, the zone setting unit 190 executes step S810 of determining whether there is at least one indoor unit 120 associated with the difference $e^k_m$ less than 0. When determining in step S810 that there are indoor units 120 associated with the difference $e^k_m$ less than 0, the zone setting unit 190 executes step S820 of grouping the adjacent indoor units 120 associated with the same difference $e^k_m$ (the difference between the differences $e^k_m$ is less than or equal to E which is a predetermined value) to form and set a new zone. If it is determined in step S810 that there is no indoor unit 120 associated with the difference $e^k_m$ less than 0, the process returns to step S800. For example, referring to FIG. 10, the group of the indoor units 120 associated with the difference $e^k_m$ of −2 is newly set as a zone Z17d. In addition, the group of the indoor units 120 associated with the difference $e^k_m$ of −3 is newly set as a zone Z17e.

Referring to FIG. 10, each air conditioning capacity compensating unit 270 is a device, such as a fan or air blowing direction control unit provided for the indoor unit 120 or a separately installed machine having a function of controlling the amount of air flow and the air blowing direction of air flow. The air conditioning capacity allocation calculating unit 210 determines the overlaps between the zones. Then, the air conditioning capacity allocation calculating unit 210 executes step S830 of allowing the air conditioning capacity compensating units 270 to control the air blowing direction so that air is blown from the nearest indoor unit 120 in the non-overlapping zone (Z17a, for example) to the nearest indoor unit 120 (or the place in which the indoor environment sensor 132 is disposed) in the overlapping zone (Z17d or Z17e, for example). If there are a plurality of overlapping zones next to the indoor unit 120 in the non-overlapping zone, the air blowing direction is controlled so that air is blown to the nearest indoor unit 120 (or the place in which the indoor environment sensor 132 is disposed) in each overlapping zone next to the indoor unit 120.

Subsequently, the air conditioning capacity allocation calculating unit 210 executes step S840 of calculating the capacity of each of the outdoor units 110, the indoor units 120, and the air conditioning capacity compensating units 270 on the basis of, for example, the environment target value, an environment-condition-related value, the thermal conductivity of the environment, the air blowing direction of the air conditioning capacity compensating unit 270, and the time required to reach the environment target value. An example of the capacity of the air conditioning capacity compensating unit 270 is the amount of air flow of the air conditioning capacity compensating unit 270 calculated on the basis of an environment around each zone, the difference $e^k_m$ between the environment target value $o^k_m$ and the environment-condition-related value (environment sensor measured value $s^k_m$) in the overlapping zone, the difference $e^k_m$ between the environment target value $o^k_m$ and the environment-condition-related value in the non-overlapping zone, the thermal conductivity of the environment, the capacity of the outdoor unit 110, the capacity of the indoor unit 120, the air blowing direction of the air conditioning capacity compensating unit 270, and the time required to reach the environment target. In this case, the time required decreases over time.

Subsequently, the control instructing unit 240 executes step S850 of transmitting a signal including data indicating a control target value to each of the outdoor units 110, the indoor units 120, and the air conditioning capacity compensating units 270.

Furthermore, step S860 of determining whether there is at least one indoor unit 120 (or the indoor environment sensor 132) associated with the value $e^k_m$ greater than or equal to 0 in the newly set zone overlapping the other zones is executed. If it is determined that there is at least one indoor unit 120 (or indoor environment sensor 132) associated with $e^k_m$ greater than or equal to 0, step S870 of removing an area in which the indoor unit 120 (or indoor environment sensor 132) is present from the newly set zone is executed. On the other hand, if it is determined in step S860 that there is no indoor unit 120 (or indoor environment sensor 132) associated with $e^k_m$ greater than or equal to 0, the process returns to step S800.

Subsequently, step S880 of determining whether the newly set zones include a zone to which any indoor unit 120 (or indoor environment sensor 132) associated with $e^k_m$ less than 0 does not belong is executed. If it is determined that the zone to which such an indoor unit 120 (or indoor environment sensor 132) does not belong is included, step S890 of removing the zone is executed. On the other hand, if it is determined in step S880 that any zone to which such an indoor unit 120 (or indoor environment sensor 132) does not belong is not included, the process returns to step S800.

Subsequently, step S900 of determining whether to terminate this series of steps is executed. If it is determined to terminate the series of steps, the process is terminated. If it is determined in step S900 not to terminate the series of steps, the process returns to step S800. The above-described series of steps is again performed.

As described above, the air-conditioning control device according to Embodiment 4 sets a new zone including a group of the indoor units 120 having insufficient capacity such that the new zone overlaps other existing zones, and controls the amounts of air flow and the air blowing directions using the indoor units 120 which allow the capacity to be shifted and the air conditioning capacity compensating units 270 to shift the capacity from the indoor units 120 in the existing zones to the indoor units 120 included in the new zone, serving as the next area. Thus, the environment in the new zone can also be brought close to the environment target while the power consumption of the entire system is limited.

REFERENCE SIGNS LIST

110 outdoor unit 120 indoor unit 131 outdoor environment sensor 132 indoor environment sensor 133 environment status input unit 140 power measuring unit 150 system model D/B 160 environment information collecting unit 170 environment target value setting unit 180 measurement D/B 190 zone setting unit 200 zone load calculating unit 210 air conditioning capacity allocation calculating unit 220 environment condition predicting unit 230 evaluating unit 240 control instructing unit 250 input unit 260 output unit 270 air conditioning capacity compensating unit

The invention claimed is:

1. An air-conditioning unit control device that controls an air-conditioning unit system including one or more outdoor units and a plurality of indoor units connected to the outdoor units by pipes, the indoor units being configured to condition air in a space, the air-conditioning unit control device comprising:

an environment target value setting unit configured to set an environment target value for an environment intended to be achieved by air conditioning through each of the indoor units;

a zone setting unit configured to form one or more groups of the indoor units and set a zone for each of the groups or change the zone based on a difference between the environment target value and an environment-condition-related value detected by indoor environment condition detecting unit in an installation position for each of the indoor units, the zone serving as a subspace;

a zone load calculating unit configured to calculate a heat load on the zone set or changed by the zone setting unit;

an air conditioning capacity allocation calculating unit configured to calculate and determine an allocation of operation capacity to each of the indoor units and the outdoor units based on power consumption of each of the indoor units and the outdoor units so as to minimize the total power consumption;

a control instructing unit configured to transmit a control signal based on the operation capacity of each of the indoor units and the outdoor units calculated by the air conditioning capacity allocation calculating unit to each of the indoor units and the outdoor units; and an environment status input unit configured to input data representing qualitative information which is an environment-status-related value, wherein the environment target value setting unit changes the environment target value based on each environment-condition-related value and the environment-status-related value.

2. The air-conditioning unit control device of claim 1, wherein when the zone setting unit determines that a difference between the environment target value and each environment-condition-related value in a first zone is greater than or equal to 0 and a difference between the environment target value and each environment-condition-related value in a second zone next to the first zone is less than 0 while the air-conditioning unit system is in a cooling operation, the zone setting unit allows the first zone to include the second zone.

3. The air-conditioning unit control device of claim 1, wherein the zone setting unit forms one or more groups of the indoor units based on the difference between the environment target value and each of the environment-condition-related values and sets the zone for each of the groups.

4. The air-conditioning unit control device of claim 1, further comprising:

an environment condition predicting unit configured to predict a time period and energy consumption for an environment condition in the zone to reach a target environment value based on the allocations determined by the air conditioning capacity allocation calculating unit.

5. The air-conditioning unit control device of claim 1, wherein the zone setting unit forms a plurality of groups of the one or more indoor units based on the difference between the environment target value and each of the environment-condition-related values and adds, changes, or removes a zone in which one or more indoor units in one of the groups are shared with another of the groups.

6. The air-conditioning unit control device of claim 1, wherein the zone setting unit changes the zones based on the difference between the environment target value set for each zone and set for each time period and either of each environment-condition-related value and the environment status.

7. The air-conditioning unit control device of claim 1, wherein the air conditioning capacity allocation calculating unit calculates the operation capacity of each of the outdoor units and each of the indoor units or air conditioning capacity compensating units based on the environment target value, the environment-condition-related value, and time required to reach the environment target value.

8. The air-conditioning unit control device of claim 1, wherein the zone setting unit forms a plurality of groups of the one or more indoor units based on a target value of power consumption of the indoor units, the outdoor units, and another power consuming device for a predetermined time period and the difference between the environment target value and each of the environment-condition-related values, and sets or changes the zones such that one or more indoor units in at least one group are shared with another group.

9. A non-transitory computer readable medium comprising computer program instructions that cause a computer to execute a method for controlling an air-conditioning unit system including one or more outdoor units and a plurality of indoor units connected to the outdoor units by pipes, the indoor units being configured to condition air in a space, the method comprising:

setting step of setting an environment target value for an environment intended to be achieved by air conditioning through each of the indoor units;

forming one or more groups of the indoor units and setting a zone tier each of the groups or changing the zone based on a difference between the environment target value and an environment-condition-related value detected by indoor environment condition detecting unit in an installation position for each of the indoor units, the zone serving as a subspace;

calculating a heat load on the zone set or changed;

calculating and determining an allocation of operation capacity to each of the indoor units and the outdoor units based on power consumption of each of the indoor units and the outdoor units so as to minimize the total power consumption;

transmitting a control signal based on the operation capacity of each of the indoor units and the outdoor units calculated to each of the indoor units and the outdoor units; and predicting a time period and energy consumption for an environment condition in the zone to reach a target environment value based on the determined allocation.

* * * * *